United States Patent [19]

Simons

[11] Patent Number: 4,857,448

[45] Date of Patent: Aug. 15, 1989

[54] PHOTOGRAPHIC SILVER HALIDE ELEMENT AND PROCESS

[75] Inventor: Michael J. Simons, Eastcote, United Kingdom

[73] Assignee: Eastman Kodak Company, Rochester, N.Y.

[21] Appl. No.: 167,271

[22] Filed: Mar. 11, 1988

[30] Foreign Application Priority Data

Apr. 7, 1987 [GB] United Kingdom ..... 8708275
May 19, 1987 [GB] United Kingdom ..... 8711829

[51] Int. Cl.[4] ..... G03C 7/26; G03C 7/32; G03C 5/24; G03C 1/46

[52] U.S. Cl. ..... 430/544; 430/434; 430/486; 430/487; 430/505; 430/506; 430/543; 430/567; 430/957

[58] Field of Search ..... 430/567, 505, 506, 549, 430/957, 543, 487, 486, 434

[56] References Cited

U.S. PATENT DOCUMENTS

| | | | |
|---|---|---|---|
| 3,379,529 | 4/1968 | Porter et al. | 430/544 |
| 3,930,863 | 1/1976 | Shiba et al. | 430/505 |
| 4,390,618 | 6/1983 | Kobayashi et al. | 430/543 |
| 4,414,308 | 11/1983 | Hamada | 430/505 |
| 4,433,048 | 2/1984 | Solberg et al. | 430/569 |
| 4,434,226 | 2/1984 | Wilgus et al. | 430/567 |
| 4,439,520 | 3/1984 | Kofron et al. | 430/434 |
| 4,518,682 | 5/1988 | Kobayashi et al. | 430/555 |

FOREIGN PATENT DOCUMENTS

| | | |
|---|---|---|
| 1178477 | 11/1984 | Canada . |
| 0062202 | 10/1982 | European Pat. Off. . |
| 0167168 | 1/1986 | European Pat. Off. . |
| 1500497 | 2/1978 | United Kingdom . |
| 1525101 | 9/1978 | United Kingdom . |
| 1584113 | 2/1981 | United Kingdom . |
| 1584280 | 2/1981 | United Kingdom . |

*Primary Examiner*—Mukund J. Shah
*Attorney, Agent, or Firm*—Richard E. Knapp

[57] ABSTRACT

An improved photographic silver halide element comprises a support, and an emulsion layer unit containing one or more photographic silver halide emulsions sensitized to the same spectral region and, adjacent each side of the emulsion layer unit, a layer substantially free of active silver halide containing an image modifier which is a compound capable of imagewise releasing an image-modifying compound on silver halide development wherein at least one of the layers contains a dye image-forming coupler. Such a layer arrangement enables greater control of the emulsion layer's response to oxidized developer generated upon processing.

10 Claims, No Drawings

PHOTOGRAPHIC SILVER HALIDE ELEMENT AND PROCESS

This invention relates to photographic silver halide color elements and more particularly to such elements containing image-modifiers.

Photographic color elements are known which, instead of containing single red-, green- and blue-sensitive silver halide emulsion layers, contain multiple layers so that there are faster and slower emulsion layers for each color sensitivity. When emulsion layers of the same spectral sensitivity but differing speed are grouped together they may be referred to as an emulsion layer unit. It is also known to employ photographic silver halide emulsion layers which comprise a blend of silver halide emulsions of differing photographic speed.

It is further known that photographic color elements may contain, in an emulsion layer, an image-modifier, for example an image-modifying developing agent or coupler. Such modifiers, on silver halide development, release a compound which has an image-modifying effect. Such compounds may, for example, increase or decrease the sensitivity of an emulsion, increase or decrease the developability of emulsion grains, or be precursors to such compounds. A widely used class of image-modifiers are DIR (Development Inhibitor Releasing) couplers.

Other image-modifiers are known, for example the inhibitor releasing developing agents (IRDs) described in U.S. Pat. No. 3,379,529.

It has previously been proposed to locate a DIR coupler in or adjacent to the emulsion layer with which it is associated, for example in British specification Nos. 1,500,497 and 1,584,113. Further IRDs have been incorporated in emulsion layers, e.g. in both the fast and slow green- and red-sensitive emulsion layers as described in U.S. Pat. No. 3,930,863 and European specification No. 167,168A2.

The image-modifying effect has generally been found to be inadequate when it has arisen from, for example, an image-modifying coupler located only in a layer on one side of the emulsion-containing layer.

When two or more photographic emulsions are present together in a single layer or in adjacent layers, they frequently develop at different rates, or show different responses to the released chemical. This can result in the image-modifying action affecting predominantly one or the other of the emulsions, or a particular part of the exposure scale.

We have now found that locating the image modifier in adjacent layers on each side of a blended and/or multiple emulsion layer unit enables greater control of the emulsion layer's response to the oxidized developer which is generated, and thus greater control of the image modifying action throughout the exposure scale. In addition the lengthened diffusion path of the oxidized developer can provide effects analogous to those obtained by image modifying couplers containing timing groups to delay release. Further, these effects can be achieved with greater economy of image modifying coupler when it is located on both sides of the emulsion-containing layer, as well as within the emulsion-containing layer if required.

Hence the present invention enables improved control of the image-forming and image-modifying chemistries over the whole exposure scale.

The described advantages are provided by a photographic silver halide color element comprising a support, an emulsion layer unit containing one or more photographic silver halide emulsions sensitized to the same spectral region and, adjacent each side of said emulsion layer unit, a layer substantially free of active silver halide containing an image modifier which is a compound capable of imagewise releasing an image-modifying compound on silver halide development wherein at least one of said layers contains a dye image-forming coupler.

The division of DIR coupler in particular into portions within and external to the emulsion layer unit can also improve photographic sensitivity or speed. Thus a lower concentration within the emulsion-containing layer will diminish the speed loss which often arises from the use of DIR coupler. The greater concentration external to the emulsion containing layer will however still be available in areas of high image density, providing an adequate total level of image modifying effect.

The term "active silver halide" herein refers to silver halide which takes part in the image forming process, for example by being photosensitive, developable or capable of adsorbing photographic reagents. The layers which are substantially free of active silver halide are alternatively referred to below as silver halide-free layers.

The two silver halide-free layers may be contiguous to the silver halide layer or separated therefrom by intervening layers provided that the oxidized color developing agent generated in the emulsion layer(s) is not unduly inhibited from diffusing to the two silver halide-free layers.

The image-modifiers and the image-forming couplers employed may be divided among the silver halide and silver halide-free layers as required. More than one type of each may be used in the same or different layers as desired.

The image-modifiers are preferably couplers or developing agents which have attached thereto either directly or via a timing or linking group the radical of a compound which modifies the rate or extent of the development process, for example a development inhibitor or a development accelerator; alternatively it may be the radical of a bleach accelerator. Examples of timing groups are described in U.S. Pat. Nos. 4,248,962 and European specification No. 167,168.

The image modifiers are developer inhibitor releasing (DIR) couplers, e.g. as described in U.S. Pat. No. 3,227,554, developer inhibitor anchimeric releasing (DIAR) couplers having a timing group, e.g. described in U.S. Pat. No. 3,930,863, development accelerator releasing (DAR) couplers, e.g. as described in British Pat. No. 2,097,140, bleach accelerator releasing couplers, e.g. as described in European Patent specification No. 193,389, Foggant Releasing Couplers, e.g. as described in British Pat. No. 2,131,188, and inhibitor releasing developers (IRDs) e.g. as described in U.S. Pat. No. 3,379,529 or European specification No. 167,168. In addition there may be used any of the many image-modifying couplers described in *Research Disclosure,* December 1978, Item 17643, Section VII paragraph F, published by Industrial Opportunities Ltd., The Old Harbourmaster's, 8 North Street, Emsworth, Hants P010 7DD, U.K. This publication will be identified hereafter as "Research Disclosure".

The photographic elements can be single color elements or multicolor elements. Multicolor elements may contain dye image-forming units sensitive to each of the three primary regions of the spectrum coated on a support. Each unit can be comprised of a single emulsion layer containing mixed grain emulsion or of multiple emulsion layers sensitive to a given region of the spectrum. The layers of the element, including the layers of the image-forming units, can be arranged in various orders as known in the art.

As examples of how the emulsion layer units of the present invention may be arranged, the following illustrative diagrams are given:

| | |
|---|---|
| I.M. Layer<br>Blended Emulsion<br>I.M. Layer<br>(1) | I.M. Layer<br>Fast Emulsion<br>Slow Emulsion<br>I.M. Layer<br>(2) |
| I.M. Layer<br>Fast Emulsion<br>Medium Emulsion<br><br>Slow Emulsion<br>I.M. Layer<br>(3) | I.M. Layer<br>Fast Emulsion<br>Blended Emulsion<br>I.M. Layer<br>(4) |
| I.M. Layer<br>Blended Emulsion<br>Blended Emulsion<br>I.M. Layer<br>(5) | |

In each of cases (1) through (5), the I.M. (image modifier) layers at the top and bottom are the silver-halide-free layers. The blended emulsion layers may, for example, comprise blends of up to four different emulsions. The blended emulsion of structure (4) may contain a medium and slow emulsion and optionally a very slow emulsion. Those of structure (5) can comprise a blend of fast and medium in the top layer and medium and slow in the bottom layer or, alternatively, fast and medium in the top layer and slow and very slow in the bottom.

A typical multicolor photographic element would comprise a yellow dye image-forming unit comprises of at least one blue-sensitive silver halide emulsion layer having associated therewith at least one yellow dye-forming coupler, and magenta and cyan dye image-forming units comprising at least one green- or red-sensitive silver halide emulsion layer having associated therewith at least one magenta or cyan dye-forming coupler respectively. The element can contain additional layers, such as filter layers.

The silver halide emulsion employed in the element can be either negative-working or positive-working. Suitable emulsions and their preparation are described in Research Disclosure Sections I and II and the publications cited therein. The grains of the emulsions may be of any size and shape, for example the grains may be cubic, octahedral or tabular. Tabular grain emulsions are described, for example, in British specification Nos. 2,109,576, 2,112,157 and 2,110,830. Suitable vehicles for the emulsion layers and other layers of elements of this invention are described in Research Disclosure Section IX and the publications cited therein.

The elements can include additional couplers as described in Research Disclosure Section VII, paragraphs D, E, F and G and the publications cited therein. The couplers employed can be incorporated in the elements and emulsions as described in Research Disclosures of Section VII, paragraph C and the publications cited therein.

The photographic elements or individual layers thereof, can contain brighteners (see Research Disclosure Section V), antifoggants and stabilizers (see Research Disclosure Section VI), antistain agents and image dye stabilizer (see Research Disclosure Section VII, paragraphs I and J), light absorbing and scattering materials (see Research Disclosure Section VIII), hardeners (see Research Disclosure Section XI), plasticizers and lubricants (see Research Disclosure Section XII), antistatic agents (see Research Disclosure Section XIII), matting agents (see Research Disclosure Section XVI) and development modifiers (see Research Disclosure Section XXI).

The photographic elements can be coated on a variety of supports as described in Research Disclosure Section XVII and the references described therein.

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

With negative-working silver halide emulsions this processing step leads to a negative image. To obtain a positive (or reversal) image, this step can be preceded by development with a non-chromogenic developing agent to develop exposed silver halide, but not form dye, and then uniform fogging of the element to render unexposed silver halide developable. Alternatively, a direct positive emulsion can be employed to obtain a positive image.

Development is followed by the conventional steps of bleaching, fixing, or bleach-fixing, to remove silver and silver halide, washing and drying.

The following Examples are included for a better understanding of the invention.

EXAMPLE 1

This example illustrates how the invention provides improved image sharpness or edge enhancement at high image density when DIR coupler is coated with layers on either side of the emulsion layer. Two coating structures were prepared:

(1) a conventional structure in which emulsion, coupler and DIR coupler were coated in a common layer; and (2) a structure according to the invention in which the image coupler was distributed equally between the emulsion layer and layers coated on either side of the emulsion layer, but all the DIR coupler was coated in the layers above and below the emulsion layer. Details of these structures are given below.

The photographic emulsions used were two tabular grain emulsions blended together in a ratio of 7 parts by weight of the faster component to 3 parts by weight of the slower component. The faster component was a silver bromoiodide having a 5.6% iodide content, and the grains had an average equivalent circular diameter of 1.58 μm and thickness 0.15 μm. The slower component was a 2.6% iodide silver bromoiodide, average grain diameter 0.59 μm and thickness 0.09 μm. Both were chemically sensitized with sulphur and gold, and spectrally sensitized to blue light.

The magenta image dye forming coupler used was coupler I, used as a dispersion of fine droplets (diameter less than 0.5 μm) of oil phase comprising two parts of coupler in one part of the high-boiling solvent tricresyl phosphate, dispersed in an aqueous gelatin continuous phase.

The image modifying coupler was DIR (Development Inhibitor Releaser) coupler A, in a similar dispersion whose oil phase comprised one part of coupler in two parts of tricresyl phosphate.

Coupler I

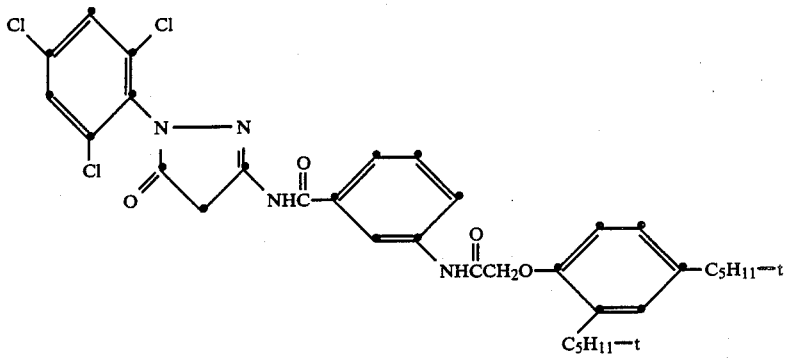

Coupler A

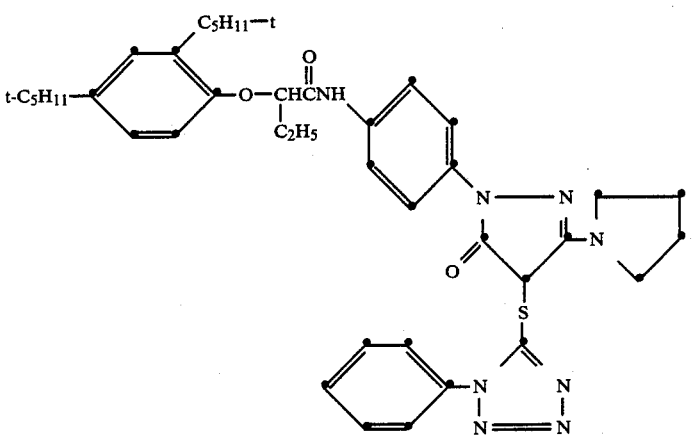

Coatings were prepared with the laydowns shown below.

They were coated on photographic film base on top of a layer of gelatin containing grey colloidal silver, to act as an antihalation layer, and were supercoated with a protective layer of 2.0 g/m$^2$ of gelatin. The figures given represent grams of substance coated per square meter of coating: the emulsion laydown is given as grams of silver per square meter.

| Coating 1 | | Coating 2 | |
|---|---|---|---|
| Gelatin | 2.0 | Gelatin | 0.50 |
| Emulsions as described | 1.0 | Coupler I | 0.30 |
| Coupler I | 0.9 | DIR Coupler A | 0.023 |
| DIR Coupler A | 0.02 | | |
| | | Gelatin | 1.0 |
| | | Emulsions | 1.0 |
| | | Coupler I | 0.30 |
| | | Gelatin | 0.50 |
| | | Coupler I | 0.30 |
| | | DIR Coupler A | 0.023 |

The two coatings were exposed to a sensitometric step wedge and processed in the C41 process described in The British Journal of Photography Annual 1977, pages 204–5, with a development time of 2.5 minutes. They showed similar contrast and maximum density, but the coating of the invention, coating 2, was 0.25 log E faster at a density of 0.2 above fog, and retained a speed advantage at all densities above fog.

The modulation transfer function (MTF) of the two coatings was measured by the sine wave method, using test patterns having 35% modulation. The exposure given was varied so that the mean density of the image varied. The results obtained are given in the following table.

| Coating | Mean Density | MTF (%) at stated frequency (cycles/mm) 2.5 | 5 | 10 | 20 |
|---|---|---|---|---|---|
| 1 (Comparative) | 0.63 | 116 | 120 | 120 | 118 |
| | 0.91 | 96 | 105 | 100 | 90 |
| | 1.09 | 103 | 105 | 98 | 84 |
| 2 (Invention) | 0.76 | 113 | 123 | 130 | 126 |
| | 1.08 | 111 | 118 | 118 | 110 |
| | 1.26 | 118 | 123 | 127 | 125 |

The coating of the invention thus showed better MTF performance without the fall-off at higher densities shown by the comparative example.

EXAMPLE 2

Coatings were prepared as in Example 1. The photographic emulsions used in this case were conventional three-dimensional silver bromoiodide color negative emulsions, green sensitized, corresponding in speed to the medium and slow emulsion components of an ISO 200 negative film, and having a speed difference between them of about 0.5 log E.

Both coatings had a layer containing the mixed emulsions together with Coupler I, and on either side of that layer, thin gelatin layers. In the case of comparative coating 3, DIR coupler A was coated in the emulsion layer only. Coating 4, a coating according to the invention, contained DIR coupler in the emulsion layer and in the two flanking layers. Laydowns are again in g/m$^2$ as before.

| Coating 3 | | Coating 4 | |
|---|---|---|---|
| Gelatin | 0.50 g/m$^2$ | Gelatin | 0.50 |
| | | DIR Coupler A | 0.020 |
| Gelatin | 2.0 | Gelatin | 2.0 |
| Faster emulsion | 1.14 | Faster emulsion | 1.14 |
| Slower emulsion | 0.58 | Slower emulsion | 0.58 |
| Coupler I | 0.60 | Coupler I | 0.60 |
| DIR Coupler A | 0.015 | DIR Coupler A | 0.008 |
| Gelatin | 0.50 | Gelatin | 0.50 |
| | | DIR Coupler A | 0.020 |

The coatings were tested as in Example 1, when both were found to have similar sensitometry. The modulation transfer function of the coating of the invention was again found to be superior over the range of image densities tested. The results are given in the table below.

| Coating | Mean Density | MTF (%) at stated frequency (cycles/mm) 2.5 | 5 | 10 | 20 |
|---|---|---|---|---|---|
| 3 (Comparative) | 0.37 | 98 | 94 | 86 | 76 |
| | 0.61 | 104 | 114 | 110 | 105 |
| | 0.79 | 101 | 112 | 113 | 108 |
| | 1.13 | 101 | 113 | 115 | 103 |
| 4 (Invention) | 0.37 | 97 | 104 | 100 | 86 |
| | 0.63 | 102 | 110 | 109 | 101 |
| | 0.79 | 107 | 113 | 116 | 113 |
| | 1.09 | 108 | 117 | 122 | 112 |

The invention has been described in detail with particular reference to preferred embodiments thereof, but it will be understood that variations and modifications can be effected within the spirit and scope of the invention.

What is claimed is:

1. A photographic silver halide color element comprising a support, an emulsion layer unit containing one or more photographic silver halide emulsions sensitized to the same spectral region and, adjacent each side of said emulsion layer unit, a layer substantially free of active silver halide and which layer contains an image-modifying compound capable of imagewise releasing an image-modifying compound on silver halide development wherein at least one of said layers contains a dye image-forming coupler.

2. An element as in claim 1 in which the emulsion layer unit contains an image modifier.

3. An element as in claim 1 or 2 in which the emulsion layer unit comprises a single layer containing a blended emulsion comprising 2–4 different emulsions.

4. An element as in claim 1 or 2 in which the emulsion layer unit comprises at least two photographic silver halide emulsion layers.

5. An element as in claim 1 or 2 in which the emulsion layer unit comprises at least one emulsion layer containing a blended emulsion.

6. An element as in claim 1 in which the emulsion layer unit comprises tabular silver halide grains.

7. An element as in claim 1 which is a multicolor element containing a yellow dye image-forming unit comprised of at least one blue-sensitive silver halide emulsion layer having associated therewith at least one yellow dye-forming coupler, a magenta dye image-forming unit comprising at least one green-sensitive silver halide emulsion layer having associated therewith at least one magenta dye-forming coupler cyan dye image-forming unit comprising at least one red-sensitive silver halide emulsion layer having associated therewith at least one cyan dye-forming coupler.

8. An element as in claim 1 in which the image modifier is a coupler or a developing agent.

9. An element as in claim 1 in which the image-modifier is capable of releasing a development inhibitor, a development accelerator, or a bleach accelerator.

10. A method of forming a photographic dye image comprising imagewise exposing a photographic element according to claim 1 and processing the exposed element to form the dye image.

* * * * *